US005816655A

United States Patent [19]

Hoegh

[11] Patent Number: 5,816,655

[45] Date of Patent: Oct. 6, 1998

[54] ARMCHAIR WITH SEATLIFT

[76] Inventor: Poul E. Hoegh, 32 Race St., San Jose, Calif. 95126

[21] Appl. No.: 802,462

[22] Filed: Feb. 20, 1997

[51] Int. Cl.[6] ..... A47C 3/32

[52] U.S. Cl. ..... 297/338; 297/344.14; 297/339

[58] Field of Search ..... 297/344.12, 338, 297/339, 344.14; 248/157, 422, 307

[56] References Cited

U.S. PATENT DOCUMENTS

| | | | |
|---|---|---|---|
| 1,870,747 | 8/1932 | Ralston | 297/339 X |
| 1,888,136 | 11/1932 | McDermott | 297/339 X |
| 2,522,180 | 9/1950 | Jones | 297/344.11 X |
| 2,578,382 | 12/1951 | Thompson | 297/344.12 X |
| 3,076,678 | 2/1963 | Griffin | 297/339 |
| 3,693,739 | 9/1972 | Kaloustian et al. | 177/214 |
| 3,894,601 | 7/1975 | Gestring | 297/344.12 X |
| 3,915,494 | 10/1975 | Somerset | 297/339 |
| 3,938,820 | 2/1976 | Nabinger | 297/339 X |
| 4,415,202 | 11/1983 | Pew | 297/339 X |
| 4,527,976 | 7/1985 | Behringer et al. | 297/344.12 X |
| 4,542,864 | 9/1985 | Hart | 242/333 |
| 5,427,337 | 6/1995 | Biggs | 297/344.12 X |

FOREIGN PATENT DOCUMENTS

| | | | |
|---|---|---|---|
| 3225546 | 1/1984 | Germany | 297/344.12 |
| 347229 | of 0000 | United Kingdom | 297/344.12 |
| 2097756 | 11/1982 | United Kingdom | 297/339 |

*Primary Examiner*—Peter M. Cuomo
*Assistant Examiner*—David E. Allred

[57] ABSTRACT

A liftchair for a disabled person, or a person with weak legs. It has a seat adapted selectively to move vertically down from a normal sitting-height and to a position close to and directly above the floor, and again up to the normal sitting height. A drive mechanism to move the seat up and down includes a reversible electric motor and reversible control switch to selectively move the seat up or down in the liftchair. A brake is included to automatically lock the seat in any vertical position upon the motor being de-activated.

7 Claims, 2 Drawing Sheets

ARMCHAIR WITH SEATLIFT

FIELD OF THE INVENTION

The present invention relates to chairs, and more particularly refers to an armchair hereinafter referred to as a liftchair having a lift mechanism to permit a physically impaired person, who has fallen on the floor and whose legs are too weak to allow him or her to get up again without help, to scoot over to the liftchair and onto the seat of the liftchair and then to be raised to a normal sitting position, from which the person can get up and walk again.

DESCRIPTION OF THE PRIOR ART

No prior art has been found where the seat goes all the way down flat on the ground. Several chairs have been disclosed in the prior art having means for assisting physically impaired persons, particularly to lift them out of the chair to a standing position. Most of these utilize levers, screws, hydraulic cylinders and other comparatively bulky devices making the chairs expensive and heavy to move around. The prior art found has been listed in the enclosed "List of prior art cited by Applicant", and a copy of a drawing of each has been enclosed.

SUMMARY OF THE INVENTION

It is an object of the invention to provide a liftchair having lift means adapted to assist a physically impaired person to rise up and walk again after having fallen on the floor. It is another object of the invention to provide a liftchair of the type described, which is easy to operate by a physically impaired person without requiring help from another individual.

It is another object of the invention to provide a lift chair in which the seat may be easily adjusted to a height that is comfortable for the user to accommodate the length of the particular user's legs.

It is another object of this invention to provide a liftchair that includes bake means to lock and maintain the seat in any vertical position.

It is another object of this invention to provide a liftchair as above, with brake means, that requires electrical power only to release the brake during up or down movement of the seat, no electrical power being required to maintain the brake in its locked position when the seat is stationary.

It is another object of this invention to provide a liftchair having a drive mechanism of which no part is located under the seat, thereby permitting the seat to go fully down to the floor. It is further an object of this invention to provide a liftchair as above that doubles as a conventional armchair, that is comfortable to sit in and is attractive to look at.

It is also an object of this invention to provide a liftchair as above that is relatively inexpensive to produce.

In the presently preferred embodiment of the invention, the raising and lowering of the seat in the chair is effected through chain means on either side of the sat acting over pulleys attached to the frame of the chair and to the sides of the seat, the seat being vertically slidably secured on a rail in the frame on either side of the seat, through annularly grooved wheels, adapted to roll up and down on each rail.

A horizontal shaft, having sprocket means fastened thereon at each end, is selectively rotated clockwise or counter clockwise through appropriate switch means, by drive means such as an electric motor. Each of the chain means located on either side of the seat runs over the sprocket means at each end of the shaft, rotation of the shaft selectively driving the chains to lift the seat to sitting position or to lower the sat to the floor position respectively. One end of each chain means is attached to an upper portion of the seat side and runs up over pulley means, over to and around one of the sprocket means, back around a second pulley means and up to be attached to a lower portion of the seat side to pull down the seat during the lowering operation, in order not to rely only on the weight of the seat to accomplish the lowering operation.

This novel chain, sprocket and pulley combination in conjunction with the rails and grooved wheels system has been utilized to minimize the width of the chair and at the same time maximize the available seat width. Utilization of this system permits lifting the seat directly under the center of gravity of the user in a very simple and inexpensively produced manner, without requiring any of the drive system to be located under the seat.

A spring loaded brake on the motor drive shaft maintains the seat in any position on the chair while the motor drive shaft is stationary. The brake is operated by a solenoid that is connected in series with the drive motor and acts against the spring loading, disconnecting the brake while the drive motor runs, but immediately releases the spring when the drive motor stops, locking the brake on the motor drive shaft when the drive motor stops, thereby preventing the seat from sliding down due to the weight of a person located on the seat, that otherwise could backdrive the drive motor. Upper and lower limit switches automatically stop the drive motor when the seat reaches its upper or lower limit position.

DESCRIPTION OF THE PREFERRED EMBODIMENTS

Figure 1:
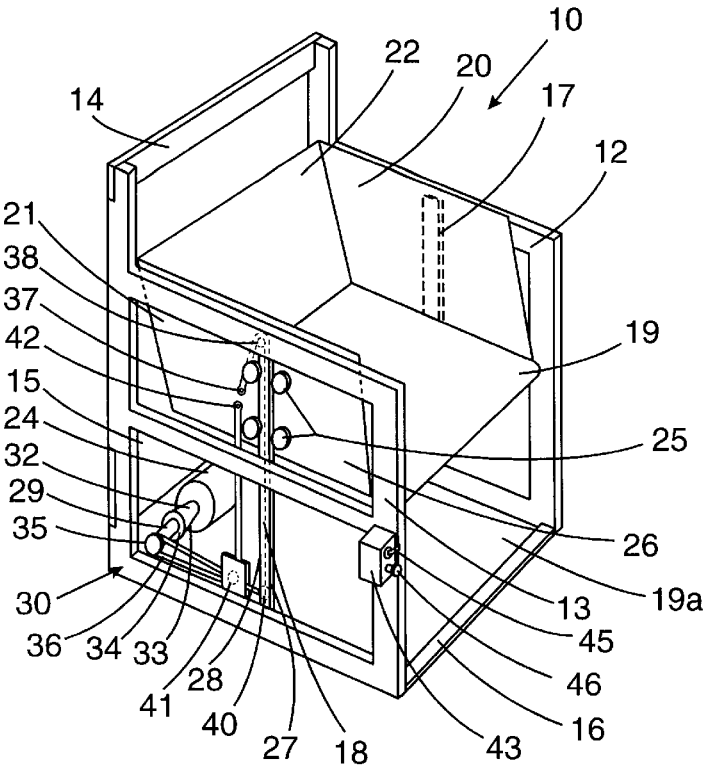
FIG. 1 is a perspective view of a liftchair having lift means according to the invention, showing the seat in its up position.
Figure 4:
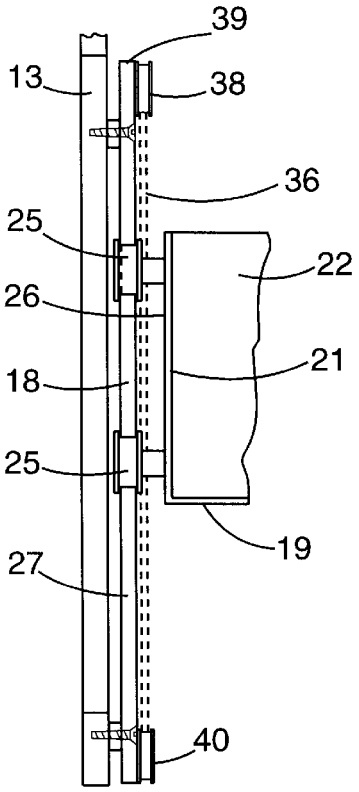
FIG. 4 is an end elevation of one of the vertical side guide rails utilized in the above invention, seen from the front of the liftchair.
Figure 2:
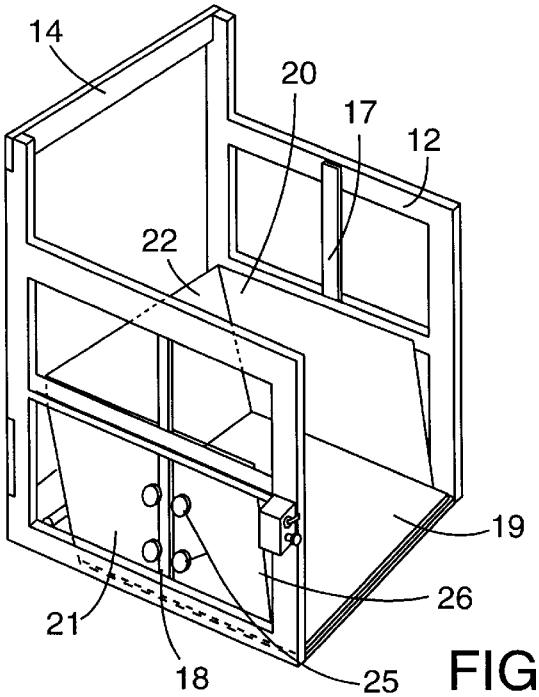
FIG. 2 is a perspective view of the liftchair of FIG. 1 showing the seat in its down position.

Referring to FIG. 1, FIG. 2, FIG. 3, and FIG. 4 a liftchair 10 according to the invention is shown, comprising a frame 11 having a left side 12 and a right side 13 connected by an upper rear crossmember 14, a lower rear crossmember 15, and a substantially flat front base crossmember 16 adapted to lie flat on the floor. One left rail 17 is firmly attached vertically, substantially centrally, internally on left side 12 of frame 11 and a right rail 18 is firmly attached, vertically, substantially centrally, internally on right side 13 of frame 11.

A seat 19 with a single flat plate bottom is located horizontally between rails 17 and 18, seat 19 having a left, upwardly depending side plate 20 and a right, upwardly depending side plate 21 attached thereto and a back plate 22 attached to back edge 23 of seat 19, back plate 22 slanting upward and backward to provide room for a reversible drive motor 24 when seat 19 is located in its lowest position. Drive motor 24 is supplied with brake 31 that is solenoid controlled by a solenoid 24*a* connected in series with motor 24 to release motor shaft 24*b* when the drive motor is activated, and lock motor shaft 24*b* when drive motor 24 is switched off. Flanged pulleys or annularly grooved wheels 25 are rotatably located on outer side 26 of right side plate 21 of the seat, (two on forward edge 27 of right rail 18 and two on rearward edge 28 of right rail 18), spaced apart in positions to maintain seat 19 in a horizontal orientation in frame 11. The mechanism on the left side 20 is a mirror image of that on the right side 21.

A horizontal driveshaft 29 is rotatably located at lower rear 30 of liftchair 10 between left side 12 and right side 13 of frame 11. Driveshaft 29 is driven by motor 24 through a motor sprocket 32, a motor drive chain 33 and a shaft drive sprocket 34 on the drive shaft 29. Each end of drive shaft 29 carries a liftchain sprocket 35. One end of a liftchain 36 is attached at upper portion 37 of right sideplate 21, liftchain 36 passing up over an upper flanged idler chain pulley 38 that is attached at upper end 39 of right rail 18, and down under a lower flanged chain pulley 40 to the underside of liftchain sprocket 35. Liftchain 36 progresses around liftchain sprocket 35 and back under a secondary flanged idler chain pulley 41 located on the lower right side 13, of liftchair 10. Liftchair 36 thereafter passes up to be attached to a lower portion of right side plate 21 at 42. Left side 12 is supplied with a similar lift chain device that is a mirror image of that on the right side 13.

A control box 43 is located on forward end 44 of frame 11, controlbox 43 containing an UP-DOWN switch 45 determining the rotation direction of reversible drive motor 24, and a momentary activation switch 46 that activates motor 31 only while activation switch 46 is pushed in and held in.

Figure 5:
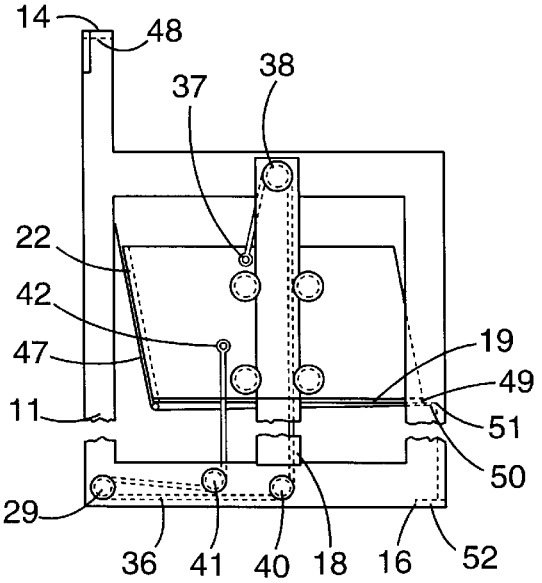
FIG. 5 is a side elevation of the guide rail shown in FIG. 4, illustrating particularly the chain and sprocket arrangement utilized in the invention.
Figure 6:
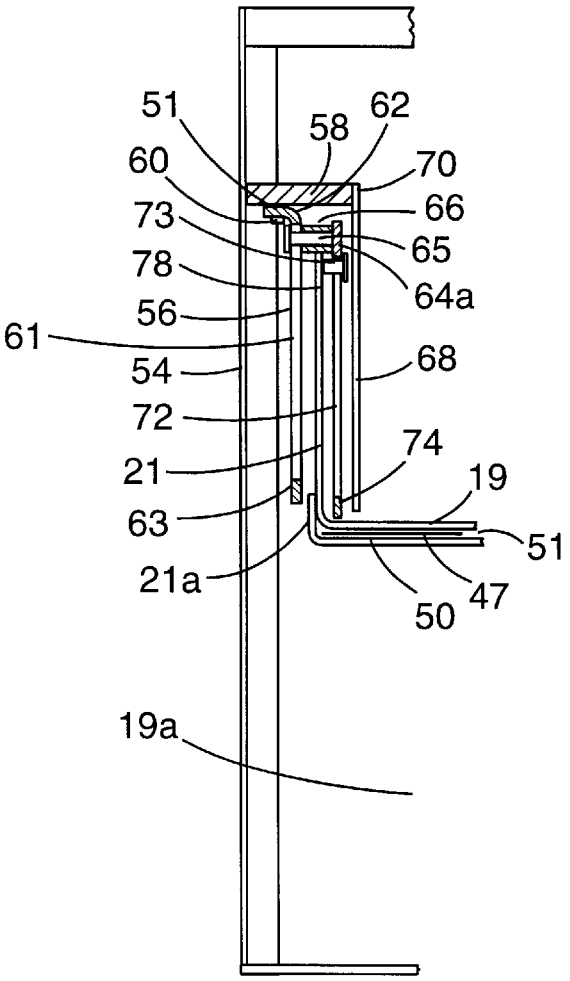
FIG. 6 is a partial, part sectional elevation of the right portion of the liftchair, seen from the front of the liftchair, showing the telescoping side protection plate mechanism with the seat in its up position.
Figure 7:
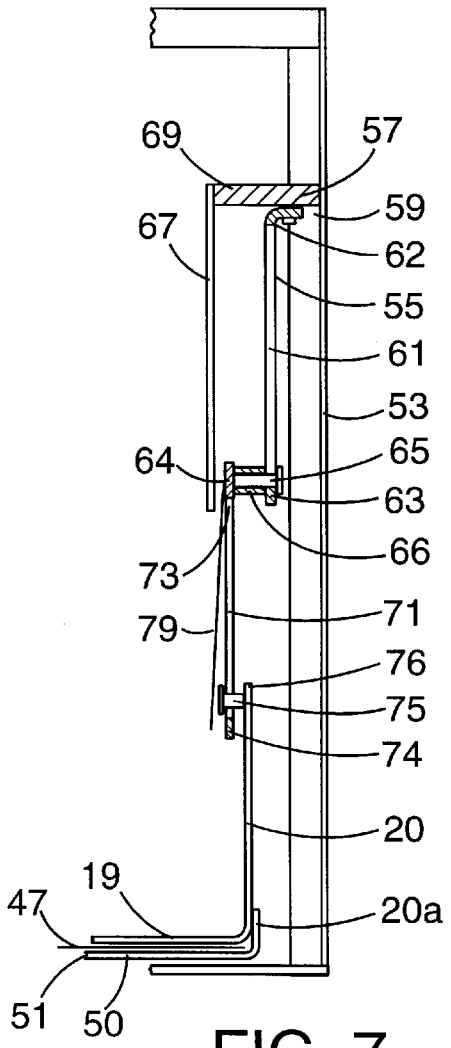
FIG. 7 is a partial, part sectional elevation of the left portion of the liftchair, seen from the front of the liftchair, showing the telescoping side protection plate mechanism with the seat in its down position.
Figure 3:
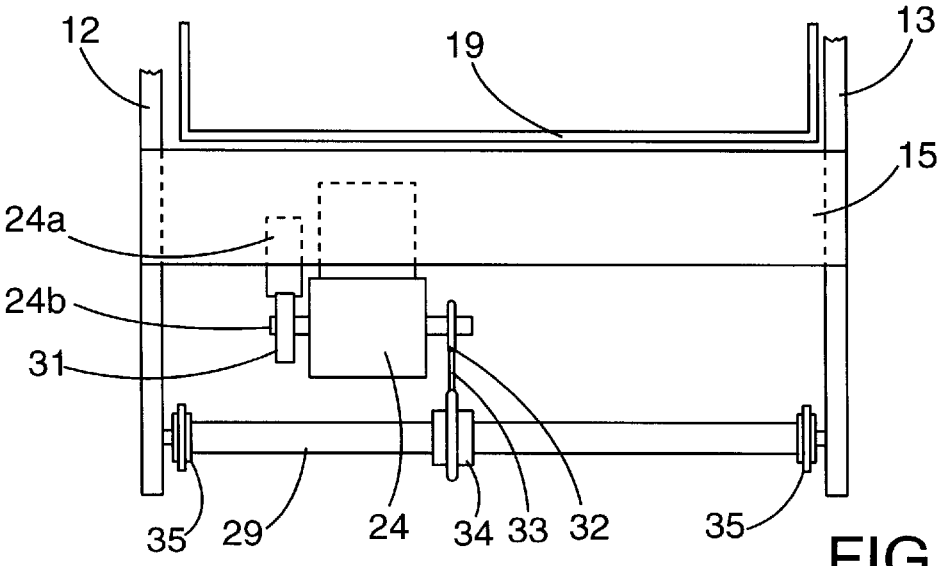
FIG. 3 is a partial rear elevation of the liftchair shown in FIG. 1, illustrating the motor drive mechanism and brake means.

Referring particularly to FIG. 5, FIG. 6 and FIG. 7 a sturdy, flexible sheet 47, such as a heavy vinyl sheet, substantially as wide as seat 19 has its upper rear end 48 attached to upper rear crossmember 14 and progresses down behind back plate 22, underneath seat 19 forward to front edge 49 of seat 19, over a round rod 50. Each end of rod 50 is bent upwardly one end being attached to left side plate 20 at 20*a*, the other end being attached to right side plate 21 at 21*a*, leaving a small space 51 between front edge 49 and rod 50, space 51 being large enough to permit sheet 47 to pass freely therethrough and down to front base cross member 16 where lower front end 52 of sheet 47 is firmly attached, seat 19 travelling up and down on sheet 47, thereby keeping opening space 19*a* between front edge 49 of seat 19 and front base crossmember 16 constantly closed and protected.

Sides 12 and 13 of the frame are covered outside by protective plates 53 and 54 to protect anyone from getting hurt by the mechanisms in the liftchair sides. The front and back of the liftchair are constantly protected by the flexible sheet 47, that passes under the seat 19 and through the space 51 and is maintained under constant tension as seat 19 moves up or down in the liftchair.

Vertical brackets 55 and 56 are attached under arm rests 57 and 58 at 59 and 60 respectively, each bracket 55 and 56 being supplied with a vertical slot 61 stretching from almost the top at 62 to almost the bottom at 63 of each bracket. Vertically slideable coverplates 64 and 64*a* are suspended in each slot 61 by studs 65 extending outward from the top of each slideable coverplate 64 and 64*a*, engaging in each slot 61, and each carrying a spacer bushing 66. Stationary plates 67 and 68 have their upper ends 69 and 70 attached to inner side of each armrest armrest 58 and 59 respectively and depends downward toward seat 19, covering the mechanisms on left side 12 and right side 13 af liftchair 10 while seat 19 is in its up position and down position, and thus protecting a user sitting on seat 19 from the mechanism on the left side 12 and from the mechanism on right side 13 as shown in FIG. 6 and FIG. 7.

Slideable coverplates 64 and 64*a* are supplied with vertical slots 71 and 72 stretching from almost at the top 73 to almost at the bottom 74 of each slidable cover plate 64 and 64*a*. A stud 75 is attached to upper end 76 of left sideplate 20, left stud 75 extending outward through slot 71 and engaging therein. A right stud 77 is attached to upper end 78 of right side plate 21, stud 77 extending outward through slot 72 and engaging therein.

Referring particularly to FIG. 7, the seat 19 is shown moved fully down, stud 75 having pulled slideable cover plate 64 down, while in turn stud 65 has moved down in slot 61, a user sitting in liftchair 10 therefore being constantly protected from contact with drive chain mechanisms etc. at sides 12 and 13 as seat 19 moves up or down.

It should be understood that the foregoing relates to only a limited number of preferred embodiments of the invention, which have been by way of example only and that it intended to cover all changes and modifications of the examples of the invention chosen herein for the purposes of the disclosure, which do not constitute departures from the spirit and scope of the invention.

LIFT CHAIR NUMBERING

10 Lift Chair
11 Frame
12 Frame Left side
13 Frame Right side
14 Upper rear cross member
15 Lower rear cross member
16 Front base cross member
17 Left rail
18 Right rail
19*a* Front open space
20 Left side plate
20*a* Left bar attachment
21 Right " "
21*a* Right bar attachment
22 Back Plate
23 Back edge
24 Drive motor
24*a* Solenoid
24*b* Motor shaft
25 Flanged pulleys
26 Outer side of plate 21
27 Forward side of rail
28 Rearward side of rail
29 Drive shaft
30 Lower rear location
31 Motor
32 Motor sprocket
33 Motor drive chain
34 Shaft drive sprocket
35 Lift chain sprocket
36 Lift chain

37 Upper right side of plate 21
38 Upper flanged chain pulley
39 Upper end of rail 18
40 Lower flanged pulley
41 Secondary flanged pulley
42 Chain attachment, lower of side plate 21
43 Control box
44 Control box location
45 UP-DOWN switch
46 Activate switch
47 Flexible sheet
48 Upper end sheet
49 Front edge seat
50 Round rod
51 Space at rod
52 Lower end sheet
53 Right cover
54 Left cover
55 Left Vertical bracket
56 Right vertical bracket
57 Left armrest
58 Right armrest
59 Left attachment
60 Right attachment
61 Vertical slots
62 Top of slot
63 Bottom of slot
64 Left cover plate
64*a* Right cover plate
65 Studs
66 Spacer bushing
67 Left stationary plate
68 Right stationary, plate
69 Upper end left plate
70 Upper end right plate
71 Slot in cover plate
72 Slot in coverplate
73 Top of slot
74 Bottom of slot
75 Stud
76 Upper end left plate
77 Right stud
78 Upper end right plate

I claim:

1. An armchair having covered lifting means for assisting a physically impaired person, who has fallen on a floor and is unable to get up again on his or her own, by allowing the person to scoot onto a seat means of said armchair adjusted in a fully down position, the person can be lifted up to a normal, fully seated position from which said person may easily stand again, comprising:

a frame having a left side and a right side connected together by an upper rear cross member, a lower rear cross member and a substantially flat front base cross member adapted to lie flat on said floor, at least one substantially vertical rail on said left side and at least one substantially vertical rail on said right side of said frame, said seat means has a seat with a single flat plate bottom, an upwardly depending left seat side, an upwardly depending right seat side, and an upwardly depending seat back rigidly attached thereto, a lifting mechanism movably connecting said seat means to said frame comprising:

support roller means movably supported on said vertical rails and adapted to roll up and down on said vertical rails, said support roller means, comprising support rollers being attached on said left seat side and said right seat side, said support rollers being adapted to permit said seat means to move up and down in said frame while retaining a substantially horizontal orientation in said armchair, drive shaft means rotatably attached in said frame, electric motor drive means located in said frame, motor drive transmission means operatively connected between said motor drive means and said drive shaft means, switch means on said frame to control said electric motor drive means, said switch means, comprising a reversing switch means to selectively control said motor drive means to rotate in a clockwise or an anti-clockwise direction, and an on/off switch means, brake means in said frame to control said motor drive means when said switch means is turned off, drive transfer means in said frame to transfer drive from said drive shaft means to said seat to move said seat up and down in said frame;

said drive transfer means including liftchains with ends attached to said left and right sides of said seat, said liftchains engaged by sprockets on said drive shaft, said liftchains thereby lifting and lowering said seat means when said motor is actuated, all of said lift mechanism being located at least as high as a lowermost srface of said seat means when the seat means is in its fully down position such that said lowermost surface is substantialy at floor level;

and safety means in said armchair to protect said person and other persons from getting hurt by moving parts of said mechanism.

2. An armchair as claimed in claim 1 in which said momentary safety switch means adapted to permit said electric motor drive means to be activated to rotate only while activating pressure is maintained on said momentary switch means, said motor drive means being switched off immediately when said pressure is released on said momentary switch.

3. An armchair as claimed in claim 2 in which said brake means includes brake control means to lock said motor drive means in stationary position at all times that said momentary switch is switched off.

4. An armchair as claimed in claim 3 in which said brake control means include spring means to lock said motor drive transmission means while said motor drive means is switched of said brake control means including a solenoid means connected in series with said motor drive means to unlock said motor drive means while said motor drive means is switched on.

5. An armchair as claimed in claim 4 in which said drive transfer means to move said seat means up and down comprises:

drive shaft sprocket means comprising said sprockets attached at each end of said drive shaft means, chain means comprising said liftchains between said drive shaft means and said seat means at each of said left side and said right side of said frame, upper and lower idler roller means located at upper and lower ends respectively of said vertical rail means, each said liftchain having one end attached to an upper portion of said left side and said right side of said seat means, said chain means passing over said upper idler roller means, down under said lower idler roller means, back to and around each of said sprockets of said driveshaft sprocket means respectively, around a secondary lower idler roller means located next to said lower idler roller means, the other end of each of said liftchains progressing up to said seat means to be attached to a lower portion of each of said left side and said right side of said seal means respectively.

6. An armchair as claimed in claim 5 in which said safety means comprises a plurality of vertically slideable plate means in each side of said frame, said plate means being connected together and to said seat means and to said frame to provide a safety cover between said person using said seat and all moving parts in sides of said armchair.

7. An armchair as claimed in claim 6 in which said frame in which said safety means includes flexible sheet means having an upper end attached to said upper rear crossmember, a lower end of said flexible sheet means passing down behind and under said seat of said seat means and forward to a front end of said seat means, a spacer bar means located at said front edge of said seat means and slightly below said front edge of said seat of said seat means said spacer bar having a bar attached to a left side of said front edge of said seat and a right end of said spacer bar attached to said right side of said front edge of said seat respectively, providing a space between said spacer bar and said front edge of said seat; said lower front end of said flexible sheet means passing through said space and downward and is fastened to said front base crossmember, to at all times maintain coverage of space between said front edge of said seat means and said front base crossmember of said frame, while said seat means moves between said fully down position and said fully seated position, at any height within this range.

* * * * *